US006476846B1

(12) United States Patent
Kashima et al.

(10) Patent No.: US 6,476,846 B1
(45) Date of Patent: Nov. 5, 2002

(54) MULTI-BEAM SCANNER AND IMAGE FORMING APPARATUS INCLUDING THE SAME

(75) Inventors: Hiroyuki Kashima, Nagoya (JP); Yumio Matsumoto, Kasugai (JP); Yutaka Hattori, Kuwana (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 25 days.

(21) Appl. No.: 09/721,735

(22) Filed: Nov. 27, 2000

(30) Foreign Application Priority Data

Nov. 25, 1999 (JP) ..... 11-334206
Nov. 25, 1999 (JP) ..... 11-334207

(51) Int. Cl.[7] ..... B41J 27/00
(52) U.S. Cl. ..... 347/241; 347/256
(58) Field of Search ..... 347/241, 243, 347/244, 256, 258, 259; 359/641, 648, 662

(56) References Cited

U.S. PATENT DOCUMENTS 6,130,701 A * 10/2000 Ito ..... 347/241

FOREIGN PATENT DOCUMENTS

JP 62-161117 A 7/1987
JP 9-26550 A 1/1997

* cited by examiner

*Primary Examiner*—Hai Pham
(74) *Attorney, Agent, or Firm*—Oliff & Berridge, PLC

(57) ABSTRACT

A multi-beam scanner has two light emitting points ch1, ch2 and an optical system. The light emitting points ch1, ch2 are separated by a distance Δalong a depth-of-focus direction. The longitudinal magnification α, or the image-side numerical aperture NA, of the optical system is set so that the surface to be scanned of a photosensitive drum is positioned within a range where the depths of focus $d_e$ of the light beams from the two light emitting points ch1, ch2 overlap. The multi-beam scanner can focus the light beams onto the surface of the photosensitive drum at all the scanning positions even when the optical system has curvature of field.

24 Claims, 9 Drawing Sheets

MULTI-BEAM SCANNER AND IMAGE FORMING APPARATUS INCLUDING THE SAME

BACKGROUND OF THE INVENTION

1. Field of the Invention

The present invention relates to a multi-beam scanner having a plurality of light emitting points, and to an image forming apparatus, such as a laser-beam printer, copier, and a facsimile machine, incorporated with the multi-beam scanner.

2. Description of Related Art

A conventional multi-beam scanner is known to have a light source unit with a laser diode array that includes a plurality of light sources. The multi-beam scanner uses the light source unit to simultaneously scan a plurality of light beams on the scan surface of a photosensitive body, in order to form an image on the scan surface. Such a multi-beam scanner increases the scanning speed and recording speed of an image forming apparatus.

The multi-beam scanner with the plurality of light sources has to produce, on the scan surface, the plurality of laser beam spots with the same, desired diameter, similarly to a scanner having a single light source. If the plurality of laser beams produce different spot diameters on the scan surface, then pixels will also become different sizes when recorded. As a result, images will become deformed or curved, or light and shade portions will be developed on the image, so that high quality images cannot be obtained.

Japanese Patent-Application Publication No. 62-161117 discloses a scanner which is provided with a mechanism for adjusting the position of the light source in a focus depth direction. In this scanner, the position of the laser array is adjusted in the focus depth direction using a screw and is fixed using a spring. As a result, the position of a collimator lens and the plurality of light sources can be adjusted so that the laser beams emitted from all the light sources have the same spot diameter along the focal depth direction.

However, this scanner requires a great number of components, which makes the scanner expensive. Further, because the position of the laser array is adjusted and fixed in the manner described above, the laser array will possibly be displaced out of position when the scanner is bumped. When the position is displaced, the desired spot diameter cannot be obtained on the scan surface.

Japanese Patent-Application Publication No. 9-26550 discloses a multi-beam scanner that reduces variations in the spot diameter that are caused by variations in image positions of the different light beams in the depth direction of the light beams. According to this multi-beam scanner, the position where the image should be formed in terms of design (desired spot position) exists in dispersion in the depth direction of the image formation positions (spot positions) of plural light beams, so that variation in spot diameter can be reduced to a minimum.

SUMMARY OF THE INVENTION

However, in the multi-beam scanner disclosed in Japanese Patent-Application Publication No. 9-26550, the optical system has a certain amount of curvature of field so that as the scanning position changes, the focal points of the laser beams will move in forward and backward (depth) directions. Therefore, depending on the scanning position, the focal points may not be properly located on the scan surface, so that printing quality suffers.

In view of the above-described drawbacks, it is an objective of the present invention to provide an improved multi-beam scanner having a plurality of light emitting points that are all properly focused on an object to be scanned at all the scanning positions, regardless of the curvature of field of the optical system employed therein.

In order to attain the above and other objects, the present invention provides a multi-beam scanner comprising: a light-emitting unit which has a plurality of light emitting portions for emitting a plurality of light beams, the plurality of light emitting portions being separated from one another in a depth direction of the light beams; a scanning unit that deflects the light beams in a main scanning direction in a plurality of lines across a surface of an object to be scanned, the plurality of lines being arranged along an auxiliary scanning direction that is substantially perpendicular to the main scanning direction; and a light converging unit converging the plurality of light beams onto the surface of the object to be scanned, the light converging unit allowing depths of focus of the light beams from all the light emitting portions to overlap on the surface of the object.

Thus, according to the present invention, the multi-beam scanner includes: a light-emitting unit that emits light beams from a plurality of light emitting points, a scanning unit that deflects the light beams to scan the light beams on an object to be irradiated, and light converging unit which is disposed between the light-emitting unit and the object to be irradiated. An optical system is constructed from the light-emitting unit, the scanning unit, and the light converging unit.

The light-emitting unit has light emitting points that are shifted from one another in the depth direction of the light beams. The optical system has a characteristic value, such as a longitudinal magnification or an image side numerical aperture, which is set to a value so that the depths of focus of light beams from all the light emitting points overlap at least partly with one another along the depth direction, and the object to be irradiated is located within the range where the depths of focus overlap.

With this configuration, because the light emitting points are separated by a distance in the depth direction, the depths of focus in the light beams from the respective light emitting points are shifted from one another at each scanning position on the object to be irradiated. To insure that the light beams from all the light emitting points be properly focused on the object at all the scanning positions, the scan surface of the object to be scanned has to be located within the range where the depths of focus of all the light beams overlap.

In order for the depths of focus of all the beams to overlap, the value derived by subtracting the shift ($\Delta S$) in the depths of focus from the range ($d_e$) of the depths of focus has to be positive. In other words, it is necessary to satisfy the following inequality:

$$d_e - \Delta S > 0.$$

It is noted that the shift amount ($\Delta S$) can be obtained by multiplying the longitudinal magnification $\alpha$ of the optical system by the distance $\Delta Z$ that separates the light emitting points from one another in the depth direction. That is, $\Delta S = \alpha \cdot \Delta Z$. Therefore, by setting the longitudinal magnification a to an appropriate value, the value, which is derived by subtracting the shift ($\Delta S$) from the range ($d_e$), will become positive, so that the depths of focus in all the light beams will overlap.

By positioning the surface of the object to be scanned within the range where the depths of focus overlap, the light beams from all the light emitting points will be properly focused on the object surface.

Especially, according to the multi-beam scanner of the present invention, the longitudinal magnification $\alpha$ of the optical system is preferably set in association with depth of focus $d_e$ according to the following inequality:

$$d_e-(\alpha\cdot\Delta Z+C_f)>0 \quad \text{(A)}$$

wherein $\Delta Z$ is the distance separating the light emitting points in the depth direction; and $C_f$ is the amount of the curvature of field caused by the optical system.

By setting the longitudinal magnification $\alpha$ to satisfy the inequality (A) described above, it can be ensured that the light beams from the all light emitting points will be properly focused on the surface of the object to be scanned, regardless of the scanning position and regardless of the amount of the curvature of field.

It is noted that according to the multi-beam scanner of the present invention, even when the light emitting surface of the light-emitting unit is not located on a plane normal to the optical axis, the optical system can be easily designed by satisfying the above-described relationship (A) while substituting the value of ($\Delta z \cos\phi+\Delta p \sin\phi$) for the distance $\Delta Z$ in the above-described inequality (A), wherein $\phi$ is an angle defined between the light emitting surface of the light-emitting unit and the plane normal to the optical axis of the light converging unit, $\Delta p$ is a distance separating the plurality of light emitting points along a plane parallel to the light emitting surface, and $\Delta Z$ in ($\Delta z \cos\phi\Delta p \sin\phi$) is the distance separating the light emitting points along a direction normal to the light emitting surface.

Because the light-emitting unit is extremely small, it is difficult to position the light-emitting unit so that the light emitting surface is precisely normal to the optical axis. However, by designing the optical system using the inequality that takes into consideration the orientation of the light emitting surface, images with high quality can be reliably obtained.

It should be noted that the optical system may be designed so that the depths of focus in the light beams, only in the main scanning direction, will overlap at least partly with one another. This is because generally the depth of focus, in the auxiliary scanning direction, is longer than that in the main scanning direction. Therefore, by designing the optical system so that the depths of focus in the main scanning direction overlap, the depths of focus in the auxiliary scanning direction will also always overlap. Thus designing the optical system is simple because attention need only be paid to the main scanning direction. Also, even though the optical system is easy to design, the optical system can produce high quality images.

Accordingly, when considering the main scanning direction, the same relationship, as indicated in inequality (A), should be satisfied.

More specifically, the longitudinal magnification $\alpha_m$, along the main scanning direction, of the optical system should be determined by the following inequality (B) in association with the focal depth dem along the main scanning direction:

$$d_{em}-(\alpha_m\cdot\Delta Z_m+C_{fm})>0 \quad \text{(B)}$$

wherein $\Delta Z_m$ is a distance separating, in the depth direction, the central positions of the radiations, along the main scanning direction, from the light emitting portions; and $C_{fm}$ is the amount of the curvature of field, along the main scanning direction, in the optical system.

When the inequality (B) is satisfied, the effects the same as those described above can be obtained.

It is noted that the light emitting surface of the light-emitting unit may not be oriented completely normal to the optical axis of the optical system. In this case, the amount of ($\Delta z_m \cos\phi+\Delta p \sin\phi$) may be substituted for the distance ($\Delta Z_m$) in the inequality (B), wherein $\phi$ is an angle defined between a light emitting surface of the light-emitting unit and a plane normal to the optical axis of the light converging unit; $\Delta p$ is a distance, along a plane parallel to the light emitting surface, separating the plurality of light emitting portions; and $\Delta z_m$ in ($\Delta z_m \cos\phi+\Delta p \sin\phi$) is a distance, along a direction normal to the light emitting surface, separating the central positions of radiations, along the main scanning direction, from the plurality of light emitting portions.

Thus, according to the present invention, the light beams from all the light emitting points will be reliably focused onto the surface of the object to be scanned.

The longitudinal magnification $\alpha_m$, along the main scanning direction, of the optical system can be set in a manner described below.

For example, the light converging unit may include: a collimate lens for collimating, into approximate parallel beams, the light beams emitted from the light emitting points, and a scan lens (f$\theta$ lens) for scanning the collimated light beams on the surface of the object to perform a main scanning operation. In this case, the focal length $f_{co}$ of the collimate lens and the focal length $f_m$, in the main scanning direction, of the scan lens should satisfy the following inequality (C):

$$(f_m/f_{co})^2\cdot\Delta z_m+C_{fm}<d_{em} \quad \text{(C).}$$

The inequality (C) can be obtained from the inequality (B) as described below.

The longitudinal magnification $\alpha_m$, in the main scanning direction, can be represented using the following equation:

$$\alpha_m=(f_m/f_{co})^2,$$

wherein $f_m$ is the focal length in the main scanning direction of the scan lens; and $f_{co}$ is the focal length of the collimator lens.

By applying the above-described equation to the inequality (B), the inequality (C) can be obtained.

Thus, as described above, high quality images can be obtained by designing the collimate lens and the scan lens to satisfy the inequality (C).

It is noted that if the focal depth $d_e$ in the inequality (A) is taken into consideration, it can be said that the optical system should be designed to satisfy the following inequality (D):

$$d_e>(\alpha\cdot\Delta Z+C_f) \quad \text{(D).}$$

It is noted that the focal depth $d_e$ is closely related to the image-side numerical aperture NA of the optical system.

The inequality (D) can be expressed by the following inequality (E):

$$2(\lambda/2NA^2+2y/NA-2W_0/NA^2)>\alpha\cdot\Delta Z+C_f \quad \text{(E)}$$

wherein $\Delta Z$ is a distance separating the light emitting points in the depth direction, $\alpha$ is a longitudinal magnification of the optical system, $C_f$ is the amount of the curvature of field in the optical system;

$W_0$ is an inherent wavefront aberration of the optical system;

$\lambda$ is a wavelength of the light beams; and y is a height of an image.

Thus, the distance $\Delta Z$ can be determined in association with the image-side numerical aperture NA.

As the amount of the image-side numerical aperture NA decreases, the amount of the distance $\Delta Z$ separating the focal depths of the light beams will increase. As the amount of the image-side numerical aperture NA increases, the amount of the distance $\Delta Z$ will decrease. Accordingly, by setting the image-side numerical aperture NA to a proper value, light beams from all the light emitting points can reliably be focused onto the surface of the object regardless of the scanning position and of the amount of curvature of field.

Even when the light emitting surface of the light-emitting unit is not oriented completely normal to the optical axis of the optical system, by substituting the amount of ($\Delta z \cos \phi + \Delta p \sin \phi$) for the distance ($\Delta Z$) in the inequality (E), the optical system can be easily designed to satisfy the inequality (E), wherein $\phi$ is an angle defined between a light emitting surface of the light-emitting unit and a plane normal to the optical axis of the light converging unit; $\Delta p$ is a distance separating the plurality of light emitting portions along a plane parallel to the light emitting surface; and $\Delta z$ in ($\Delta z \cos \phi + \Delta p \sin \phi$) is a distance separating the plurality of light emitting portions along a direction normal to the light emitting surface.

Because the light-emitting unit is extremely small, it is difficult to locate the light-emitting unit so that the light emitting surface will be completely normal to the optical axis. However, by designing the optical system using the above-described inequality that is modified by taking tilt into consideration, images with high quality can be reliably obtained.

It should be noted that the optical system may be designed considering that the depths of focus of the light beams, only in the main scanning direction, will overlap at least partly with one another. This is because generally the depth of focus in the auxiliary scanning direction is longer than that in the main scanning direction. Therefore, by designing the optical system so that the depths of focus in the main scanning direction overlap, the depths of focus in the auxiliary scanning direction will always overlap, too. Designing the optical system is simple because attention need only be paid to the main scanning direction. Also, even though the optical system is easy to design, the optical system can produce high quality images.

Accordingly, when considering the main scanning direction, the same relationship, as indicated in inequality (E), should be satisfied.

More specifically, the inequality (E) can be represented by the following inequality (F):

$$2(\lambda/2NA_m^2+2y_m/NA_m-2W_0/NA_m^2)>\alpha\cdot\Delta Z_m+C_{fm} \quad \text{(F)}$$

wherein $\Delta Z$, is a distance separating, in the depth direction, the center portions of radiations, along the main scanning direction, from the light emitting portions, $\alpha_m$ is a longitudinal magnification, along the main scanning direction, of the optical system, $C_{fm}$ is the amount of the curvature of field, along the main scanning direction, in the optical system;

$W_0$ is an inherent wavefront aberration of the optical system;

$\lambda$ is a wavelength of the light beams; and $y_m$ is a height of an image.

Accordingly, the distance $\Delta Z_m$ can be determined by the inequality (F) in association with the image-side numerical aperture $NA_{em}$ along the main scanning direction.

The light emitting surface of the light-emitting unit may not be oriented completely normal to the optical axis of the optical system. In this case, the amount of ($\Delta z_m \cos \phi + \Delta p \sin \phi$) may be substituted for the distance ($\Delta Z_m$) in the inequality (F), wherein $\phi$ is an angle defined between a light emitting surface of the light-emitting unit and a plane normal to the optical axis of the light converging unit; $\Delta p$ is a distance, along a plane parallel to the light emitting surface, separating the plurality of light emitting portions; and $\Delta z_m$ in ($\Delta z_m \cos \phi + \Delta p \sin \phi$) is a distance, along a plane normal to the light emitting surface, separating the central positions of radiations, along the main scanning direction, from the plurality of light emitting portions.

According to another aspect, the present invention provides an image forming device comprising: a photosensitive body driven to rotate in the auxiliary scanning direction; and a multi-beam scanner, which includes: a light-emitting unit which has a plurality of light emitting portions for emitting a plurality of light beams, the plurality of light emitting portions being separated from one another in a depth direction of the light beams; a scanning unit that deflects the light beams in a main scanning direction in a plurality of lines across a surface of the photosensitive body, the plurality of lines being arranged along an auxiliary scanning direction that is substantially perpendicular to the main scanning direction; and a light converging unit converging the plurality of light beams onto the surface of the photosensitive body, the light converging unit allowing depths of focus of the light beams from all the light emitting portions to overlap on the surface of the photosensitive body, thereby serially irradiating the plurality of light beams on the photosensitive body to form latent images.

By thus applying the multi-beam scanner of the present invention to the image forming device, such as a laser beam printer, a facsimile machine, a copy machine, or the like, that includes the photosensitive body, the image forming device can produce images with high quality.

Further, by designing the image forming device so that an intermediate point, in the range where the depths of focus of all the beams overlap, falls on the surface of the photosensitive drum, the light beams will reliably be focused on the surface of the photosensitive body, even when the collimate lens, the scanning lens, or other components of the optical system are attached at wrong positions or when the refracting power of the optical system changes due to fluctuations in the ambient environment.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENT

Figure 1:
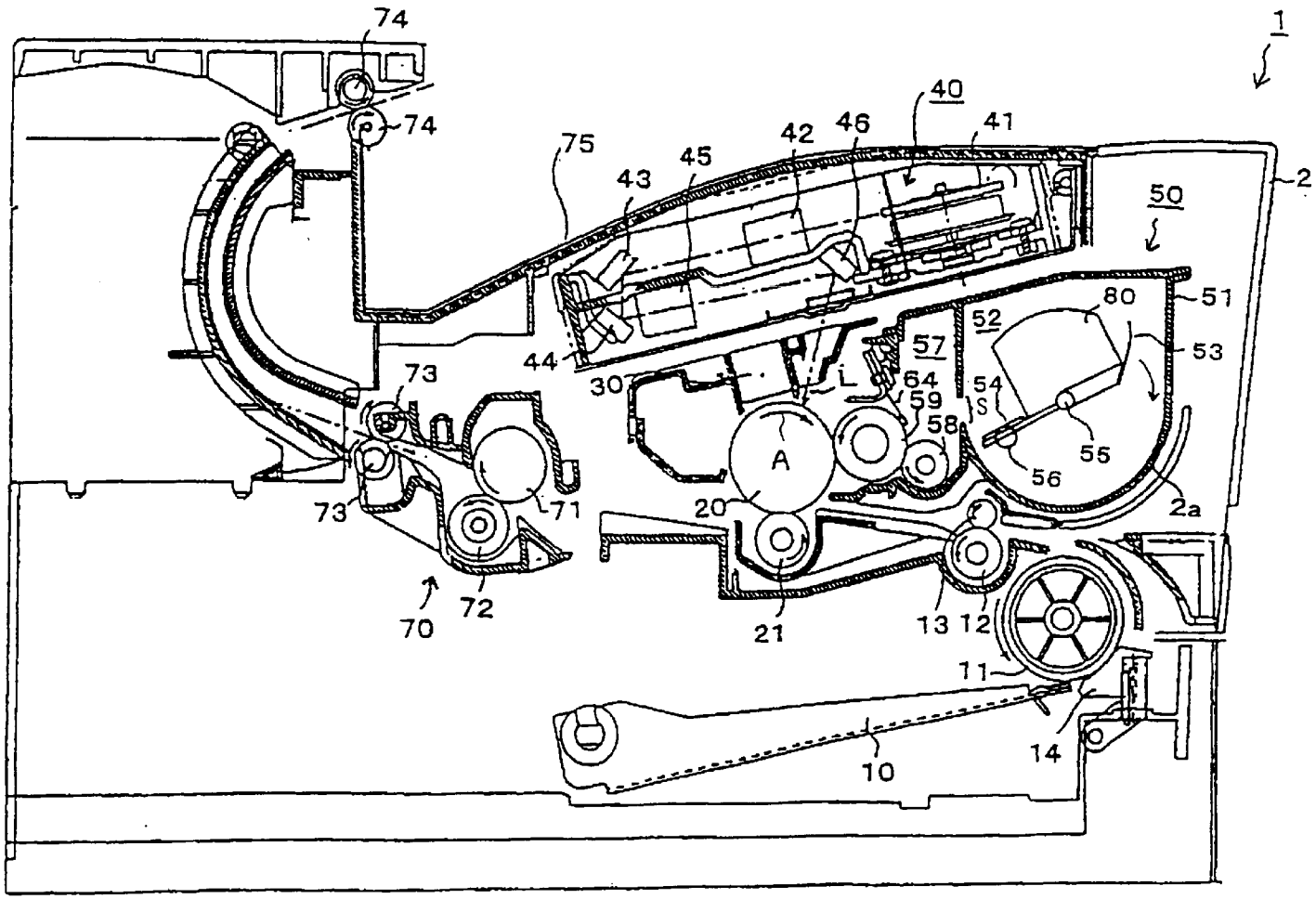
FIG. 1 is a sectional view showing a main structure of an image forming apparatus in a preferred embodiment of the invention.

A multi-beam scanner according to a preferred embodiment of the present invention will be described while referring to the accompanying drawings wherein like parts and components are designated by the same reference numerals to avoid duplicating description.

FIG. 1 is a cross-sectional view showing a laser-beam printer 1 which employs the multi-beam scanner according to the embodiment of the present invention.

As shown in FIG. 1, the laser-beam printer 1 includes a main case 2, in which there are provided a feeder unit, a pair of registration rollers 12, 13, a photosensitive drum 20, a transfer roller 21, a charging device 30, the multi-beam scanner 40, a developing cartridge 50, a fixing unit 70, a pair of conveying rollers 73, 73, and a pair of sheet ejecting rollers 74, 74.

The feeder unit is located at the bottom portion of the case 2 for feeding out sheets of paper (not shown). The feeder unit includes a sheet pressing plate 10, a sheet feed roller 11, and a friction separation member 14. The sheet pressing plate 10 is pressed by a spring. Accordingly, sheets of paper are pressed against the sheet feed roller 11 by the sheet pressing plate 10. The sheet feed roller 11 rotates in a direction indicated by an arrow in the figure. At a predetermined timing, the rotation of the sheet feed roller 11 separates an uppermost sheet into between the sheet feed roller 11 and the friction separation member 14 from the other sheets, and then feeds out the sheet.

The pair of registration rollers 12, 13 are rotatably supported at a position downstream in a sheet conveyance direction that is defined with respect to the rotation of the sheet feed roller 11. The registration rollers 12, 13 feed the sheet at a predetermined timing to an image transfer position that is formed between the photosensitive drum 20 and the transfer roller 21.

The drum body of the photosensitive drum 20 is electrically grounded, and its surface is formed with an organic photosensitive material which contains, as a main component, polycarbonate that can be charged electrically positively. The photosensitive drum 20 is supported by the main case 2 so that the photosensitive drum 20 can be rotated by a drive unit (not shown) in an auxiliary scanning direction A indicated by an arrow in the figure.

The charging device 30 is a scorotron-type charging device that produces corona discharge from a charging wire, such as a tungsten wire, to uniformly charge the surface of the photosensitive drum 20 to a positive charge.

The multi-beam scanner 40 is for scanning a plurality of (two, in this embodiment) laser beams L, in a main scanning direction M, to form a plurality of scanning lines on the surface of the photosensitive drum 20. The main scanning direction M is substantially perpendicular to the auxiliary scanning direction A. The plurality of scanning lines are irradiated on the surface of the photosensitive drum 20 at different locations along the auxiliary scanning direction A.

The developing cartridge 50 has a casing 51 that includes a toner box 52 and a developing chamber 57. In the toner box 52, an agitator 53, a cleaning member 54 and a light proof member 80 are rotatably provided around a rotational shaft 55. A light transmission window 56 is formed in a side wall of the toner box 52. The toner box 52 contains toner of a single non-magnetic component. The developing chamber 57 is disposed on the photosensitive drum 20 side of the toner box 52, and is in fluid communication with the toner box 52 via an opening S. In the developing chamber 57, a supply roller 58 and a developing roller 59 are rotatably mounted. A layer thickness-regulating blade 64 is also provided within the developing chamber 57. The layer thickness-regulating blade 64 is of a thin plate shape and has elasticity. Toner supplied onto the developing roller 59 by the supply roller 58 is formed into a thin layer of a predetermined thickness by the layer thickness-regulating blade 64, and then used for developing.

The transfer roller 21 is rotatably supported and is formed from an electrically-conductive foam material such as silicone rubber and urethane rubber. The transfer roller 21 is constructed to ensurely transfer the toner image developed on the photosensitive drum 20 onto the sheet by a transfer bias voltage applied thereto.

The fixing unit 70 is disposed downstream from a pressing portion between the photosensitive drum 20 and the transfer roller 21 along the sheet conveyance direction. The fixing unit 70 includes a heat roller 71 and a pressing roller 72. While the sheet is passing between the heat roller 71 and the pressing roller 72, toner transferred on the sheet melts and fixed.

The pair of conveying rollers 73, 73 and the pair of sheet ejecting rollers 74, 74 are provided downstream from the fixing unit 70 in the sheet conveyance direction. A discharge tray 75 is provided downstream of the sheet ejecting rollers 74, 74.

With the above-described structure, the laser beam printer 1 operates in a manner described below.

After the surface of the photosensitive drum 20 is uniformly charged positively by the charging device 30, the multi-beam scanner 40 emits a plurality of laser beams L, which are modulated based on image information, to scan a plurality of laser beam lines which are disposed at different positions along the auxiliary scanning direction A, thereby rapidly forming an electrostatic latent image on the surface of the photosensitive drum 20.

Then, the latent image is developed into a visual image by toner supplied from the developing cartridge 50. Next, the visible image formed on the photosensitive drum 20 is conveyed to the transfer position by the rotation of the photosensitive drum 20. A sheet of paper is also conveyed to the transfer position via the sheet supply roller 11 and the registration rollers 12, 13. At the transfer position, the visible image is transferred onto the sheet of paper by a transfer bias voltage applied to the transfer roller 21. Residual toner remaining on the photosensitive drum 20 after transfer is collected by the developing roller 59 and is returned to the toner box 57.

Next, the sheet is conveyed to the fixing unit 70. While the sheet is being pressed between the heat roller 71 and the pressing roller 72, the visible image on the sheet is heated and pressed, thereby being fixed on the sheet. Then, the sheet is ejected on the discharge tray 75 by the conveying rollers 73 and the sheet ejecting rollers 74. Thus, image forming operation is completed.

Next, structure of the multi-beam scanner 40 in the laser beam printer 1 will be described with reference to FIGS. 2 and 3.

Figure 2:
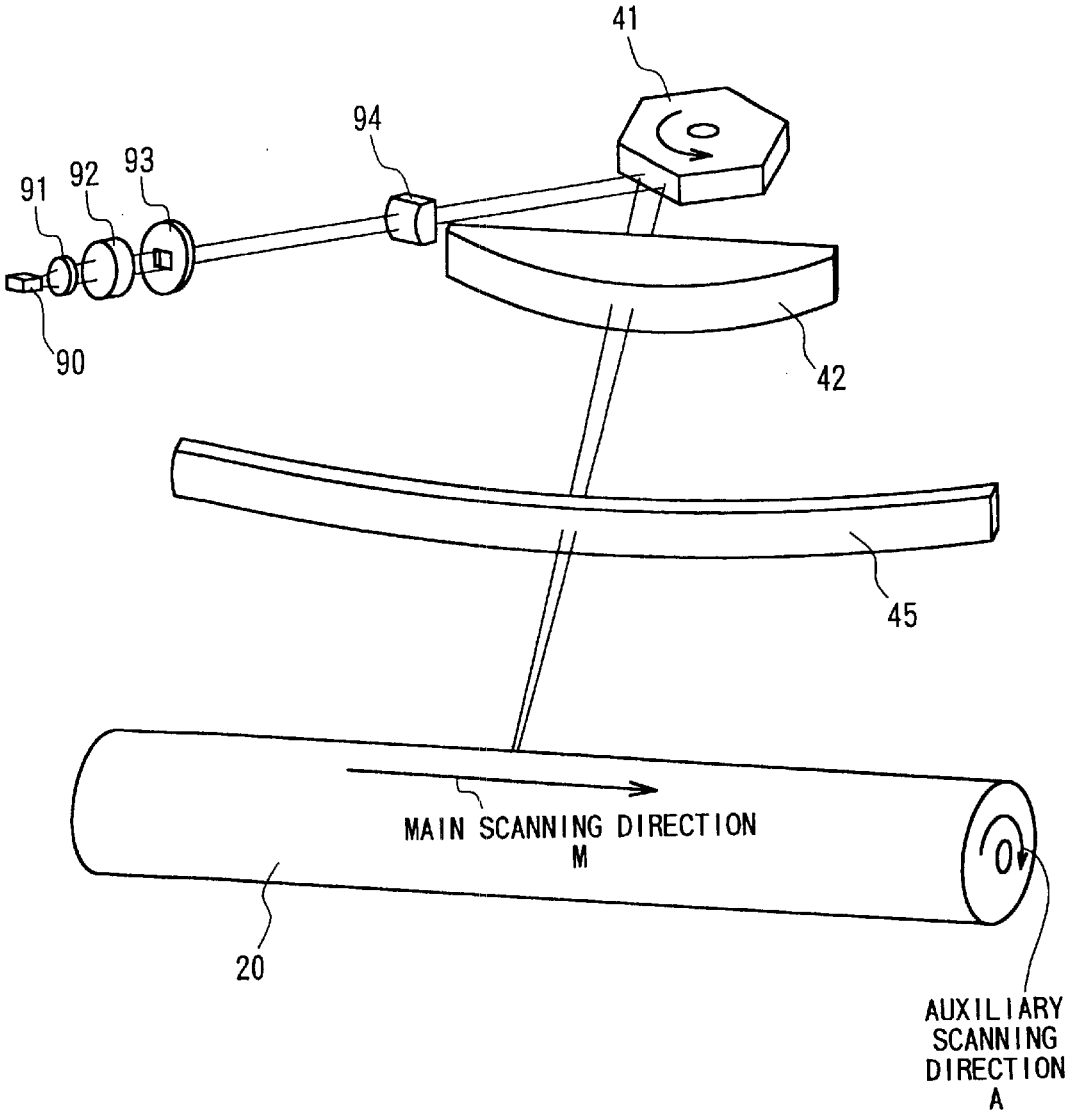
FIG. 2 is a schematic perspective view showing an entire structure of the multi-beam scanner of FIG. 1.

As shown in FIG. 2, the multi-beam scanner 40 includes a laser diode 90 which includes a plurality (two, in this embodiment) of light emitting points for emitting a plurality of laser beams L. The multi-beam scanner 40 further includes a cover glass 91, a collimator lens 92, a diaphragm 93, a cylindrical lens 94, a polygon mirror 41, an fθ lens 42, and a toric lens 45.

Although not shown in the drawing of FIG. 2, in order to accommodate all the components 90, 91, 92, 93, 41, 42, and 45 within a compact space of the multi-beam scanner 40, optical-axis bending mirrors 43, 44, and 46 are provided in the multi-beam scanner 40 as shown in FIG. 1. The mirrors 43 and 44 are for cooperating to guide the laser beams L having passed through the fθ lens 42 to the toric lens 45. The mirror 46 is for guiding the laser beams L having passed through the toric lens 45 to the surface of the photosensitive drum 20.

Figure 3:
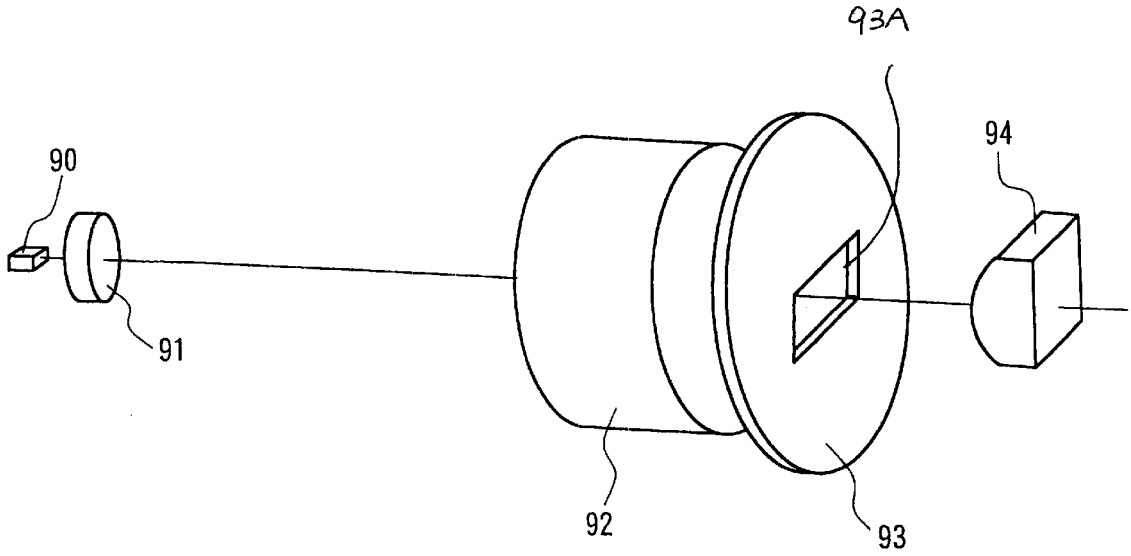
FIG. 3 is a perspective view showing a collimating portion in the multi-beam scanner of FIG. 2.

As shown in FIG. 3, the cover glass 91 is provided to cover the laser diode 90 so that the plurality of laser beams L emitted from the laser diode 90 pass through the cover glass 91. The collimator lens 92 is for collimating the plurality of laser beams L into a plurality of substantially parallel laser beams. The diaphragm 93 is formed with a slit opening 93A to limit the size of the light bundles from the collimator lens 92.

The cylindrical lens 94 is for converging the light bundles from the diaphragm 93 in the auxiliary scanning direction A only, thereby correcting for a surface tilt of the polygon mirror 41. The polygon mirror 51 is driven to rotate so as to deflect the laser beams from the cylindrical lens 94 to scan the light bundles in the main scanning direction M. The fθ lens 42 and the toric lens 45 serve as a set of scan lenses.

Figure 4:
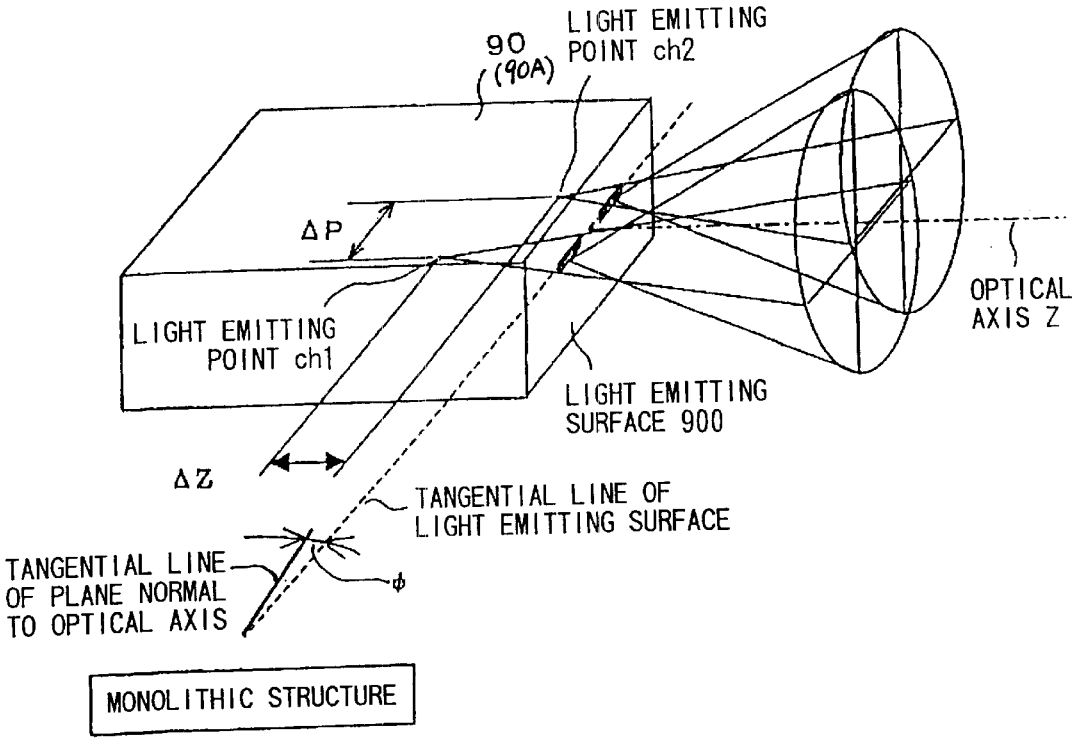
FIG. 4 is a perspective view showing a structure and light emitting points in one example of a semiconductor laser that can be used in the multi-beam scanner of FIG. 2.

In this example, the laser diode 90 has a monolithic structure, wherein the laser diode 90 is constructed from a single light emitting element 90A that has a plurality of light emitting points as shown in FIG. 4. The laser diode 90 has a light emitting surface 900. The laser diode 90 has a plurality of (two, in this example) light emitting points ch1, ch2 that are disposed to the interior of the light emitting surface 900. The laser diode 90 is disposed with respect to the optical axis Z of the optical system, which is constructed from the components 92, 93, 94, 41, 42, and 45, so that laser beams emitted from the light emitting points ch1, ch2 will pass through the light emitting surface 900 before reaching the collimate lens 92 along the optical axis Z of the collimator lens 92. Laser beams emitted from the light emitting points ch1, ch2 will be scanned simultaneously on the surface of the photosensitive drum 20 in the main scanning direction M. Thus, two scanning lines will be formed extending in the main scanning direction M on the surface of the photosensitive drum 20 at locations that are separated from each other in the auxiliary scanning direction A.

Figure 5:
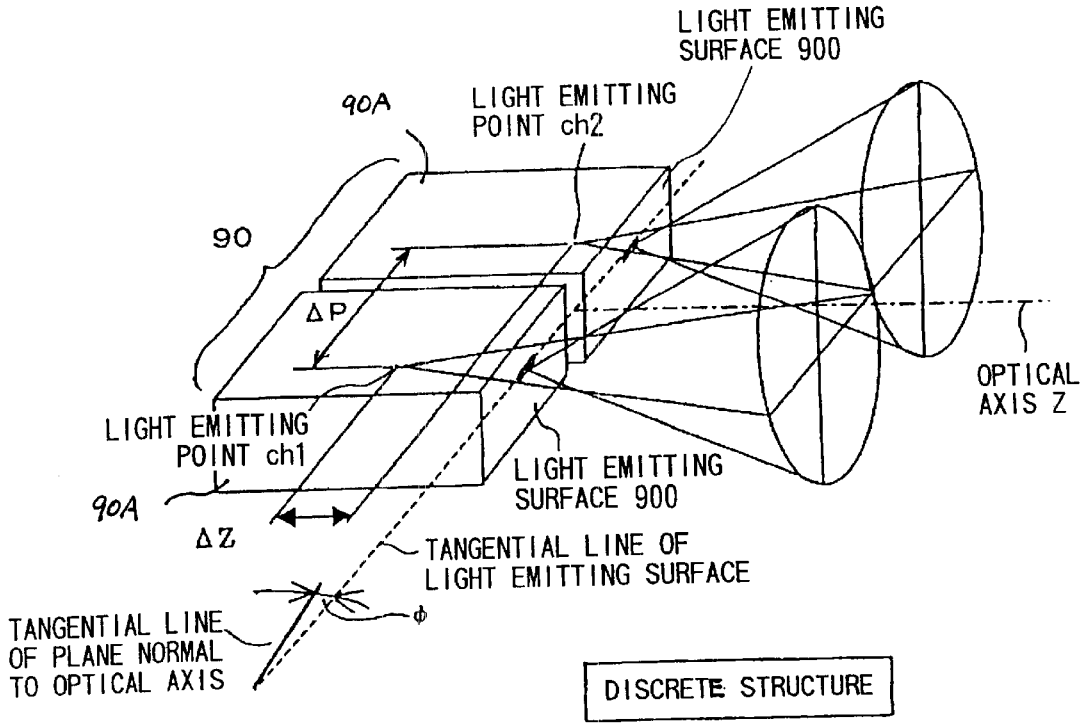
FIG. 5 is a perspective view showing a structure and light emitting points of another example of a semiconductor laser that can be used in the multi-beam scanner of FIG. 2.

It is noted that the laser diode 90 may have a discrete structure, wherein the laser diode 90 has a plurality of (two, in this example) light emitting elements 90A which have their own light emitting points respectively as shown in FIG. 5. In this case, the two light emitting elements 90A have their own light emitting surfaces 900, respectively. The respective light emitting elements have individual light emitting points ch1, ch2 that are disposed to the interior of the corresponding light emitting surfaces 900. The light emitting points ch1, ch2 emit laser beams L through the corresponding light emitting surfaces 900 in a direction along the optical axis Z. Also in this case, laser beams emitted from the light emitting points ch1, ch2 will be scanned simultaneously on the surface of the photosensitive drum 20 in the main scanning direction M. Thus, two scanning lines will be formed extending in the main scanning direction M on the surface of the photosensitive drum 20 at locations that are separated from each other in the auxiliary scanning direction A.

In both of the monolithic structure and the discrete structure, due to variations in manufacture, the light emitting points ch1 and ch2 are separated from each other by a distance ΔZ with respect to the direction of the optical axis Z.

Figure 6:
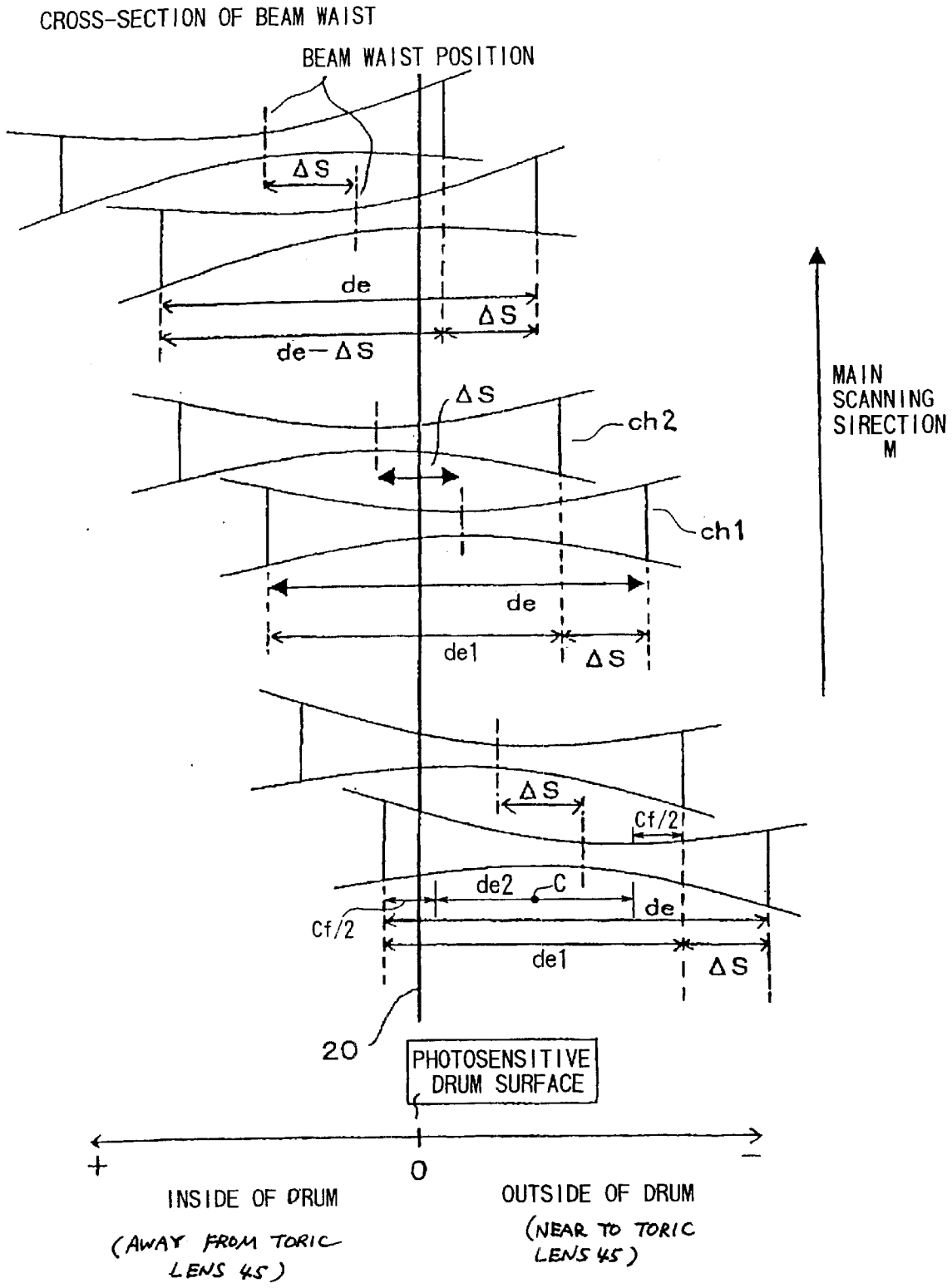
FIG. 6 is a diagram showing sections of beam waist positions of laser beams at various positions along the main scanning direction.

As shown in FIG. 6, the light beam from each of the light emitting points ch1 and ch2 has a beam waist position, where the beam spot size of the light beam is the smallest. At a position near the scan surface of the photosensitive drum 20, the light beams from the light emitting points ch1 and ch2 have their beam waist positions. However, due to the separation of the light emitting points ch1 and ch2 by the distance ΔZ, the beam waist positions of the light beams are separated from each other by a distance ΔS in their focus depth direction.

Two conditions have to be met to insure that the laser beams from both of the emitting points ch1, ch2 result in proper imaging on the scan surface of the photosensitive drum 20. That is, the depths of focus of the laser beams emitted from the light emitting points ch1, ch2 have to overlap at least partly with each other, and also the surface of the photosensitive drum 20 has to be positioned within a range where the depths of focus of the laser beams overlap each other. It is noted that the depth of focus is defined as a range of a light beam, along the optical axis, wherein an image with satisfactory definition can be formed, even though the focal point of the beam is shifted away from the subject surface. Generally, the depth of focus is a range between positions shifted from the beam waist position by a predetermined amount, forward and backward with respect to the optical axis, and has a length $d_e$.

In order that the depths of focus overlap at least partly with each other, a value $d_{e1}$ obtained by subtracting the amount of the distance ΔS from the amount of the focal depth $d_e$ has to be a positive value, that is, $d_{e1}=d_e-\Delta S>0$.

Further, as shown in FIG. 6, the beam waist position of the laser beam deviates according to the position of the laser beam along the main scanning direction M. This deviation is generally known as the curvature of field, which is due to variations in manufacture and attaching positions of optical elements such as the lenses and the mirrors.

Figure 7:
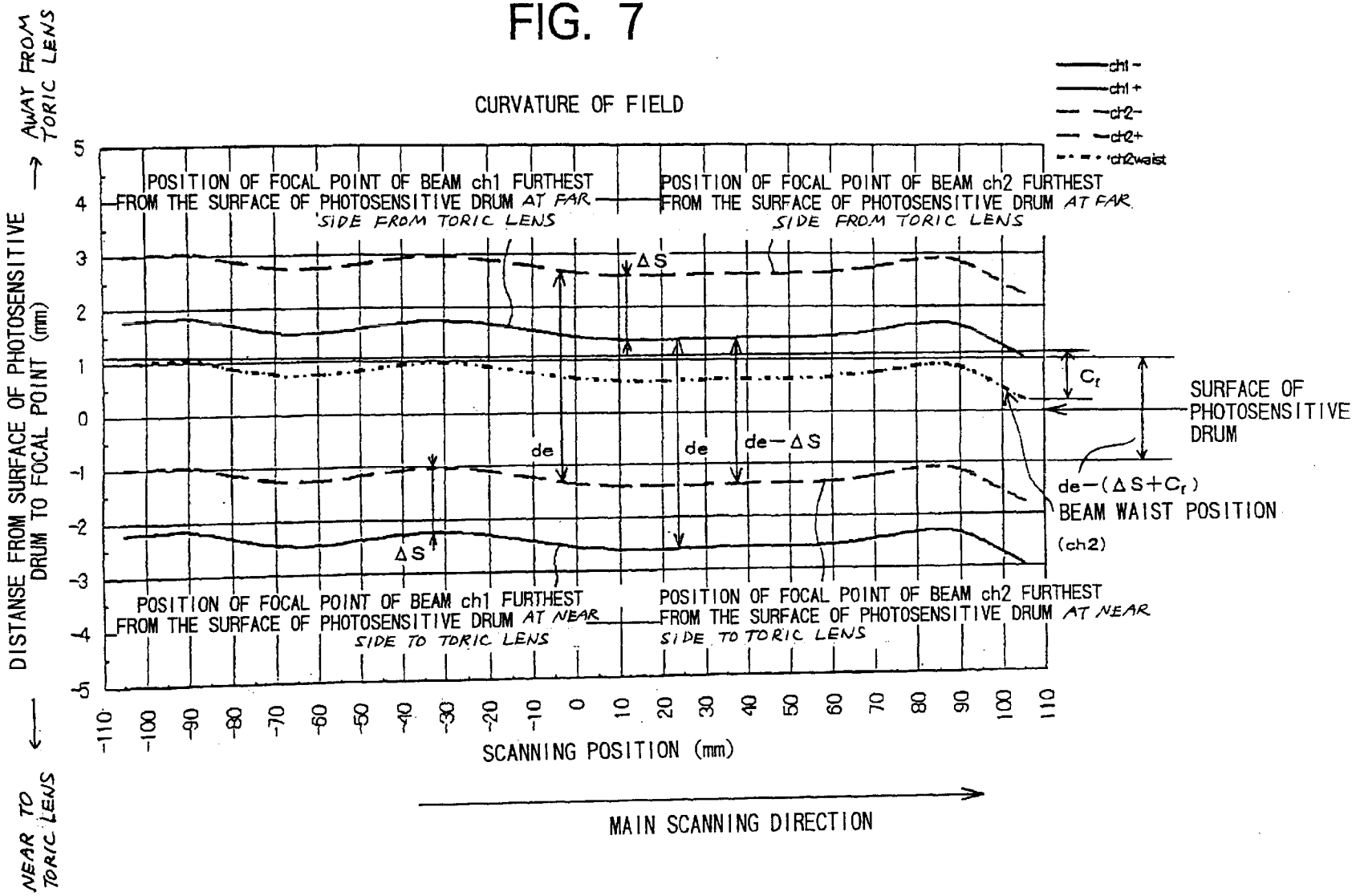
FIG. 7 is a graph showing curvature of field in the multi-beam scanner of FIG. 2.

FIG. 7 shows how the curvature of field affects the position of the beam waist of the beam, from the light emitting point ch2, over all the scanning positions of the photosensitive drum 20 along the main scanning direction M.

It is noted that the horizontal axis of FIG. 7 indicates positions on the surface of the photosensitive drum 20 along the main scanning direction M. The original position "0" on the horizontal axis indicates the center position on the surface of the photosensitive drum 20 along the main scanning direction M. The positive direction in the horizontal axis indicates the direction, along which the laser beams scan the surface of the photosensitive drum 20 as shown in FIGS. 2 and 6. The entire range of the graph along the horizontal axis indicates all the scanning positions by the laser beams, which are separated from the center position in the range of −110 mm to +110 mm.

The vertical axis of the graph indicates the distance, along the depth direction of the laser beams, from the surface of the photosensitive drum 20. The positive direction on the vertical axis indicates the direction from the photosensitive drum 20 in a direction away from the toric lens 45, that is, the direction toward the inside of the photosensitive drum 20. The negative direction on the vertical axis indicates the direction from the photosensitive drum 20 in a direction back to the toric lens 45, that is, the direction away from the inside of the photosensitive drum 20.

As indicated by a single dot chain line in this graph, due to the curvature of field, the beam waist position of the laser beam, from the light emitting point ch2, varies over all the scanning positions on the photosensitive drum 20. More specifically, due to the curvature of field, the position of the beam waist varies, along the main scanning direction M, between its farthest location that is located farthest from the toric lens 45 along the depth direction of the laser beam and its nearest location that is located nearest to the toric lens 45 in the depth direction. In this graph, the beam waist position becomes farthest from the toric lens 45 when the beam is at the scanning position of about −100 mm from the central position "0". The beam waist position becomes nearest to the toric lens 45 when the beam is at the scanning position of about +105 mm from the central position "0". The amount Cf of the curvature of field is defined as the distance, along the beam depth direction, between the nearest and farthest positions of the beam waist.

Due to the curvature of field, not only the beam waist position but also the depth of focus deviates as shown in FIG. 7. More specifically, the focal depth of the beam from the light emitting point ch1 deviates as indicated by a range between a pair of solid lines in the graph, while the focal depth of the beam from the light emitting point ch2 deviates as indicated by a range between a pair of broken lines in the graph.

It is noted that when the curvature of field occurs, if the beam waist positions of the two laser beams overlap each other within a range of a small length $d_{e1}$, then the overlapping range of $d_{e1}$ will possibly shift away from the surface of the photosensitive drum 20. In this case, the depth of focus of the laser beams, emitted from one or both of the light emitting points ch1, ch2, will not be properly positioned on the surface of the photosensitive drum 20. As a result, the spot diameter of the laser beam, where it scans the surface of the photosensitive drum 20, may become too large, resulting in poor image quality.

Considering the above-described effect, in order to properly position the surface of the photosensitive drum 20 within the depth of focus in both of the laser beams from the emitting positions ch1 and ch2 at all the scanning positions along the main scanning direction, then as shown in FIG. 6, the surface of the photosensitive drum 20 should be positioned within a range of a length $de_2$, which is defined as a range by taking away a half of the shift amount $C_f$ of the beam waist position, that is occurred due to the field curvature, from both ends of the range of amount $de_{e1}$ where the depth of focus of both the laser beams overlap each other. Whether or not this condition has been fulfilled can be determined numerically by whether or not the amount $d_{e2}=(d_e-\Delta S-C_f)$ is positive. In other words, the condition is fulfilled when the following inequality is satisfied:

$$d_{e2}=d_e-\Delta S-C_f>0.$$

It is further noted that the distance ΔS is a distance between the beam waist positions of the two beams from the light emitting points ch1 and ch2 along the focal depth direction. In other words, the distance ΔS is a distance between the focal points of the laser beams from the light emitting points ch1 and ch2 along the focal depth direction. The distance ΔS can therefore be expressed using the following formula:

$$\Delta S=\alpha\cdot\Delta Z$$

wherein

α is the longitudinal magnification of the entire optical system; and

ΔZ is a distance between the light emitting points ch1 and ch2 along the focal depth direction as shown in FIG. 4.

Therefore, in order that the scan surface of the photosensitive drum 20 will be located within the depths of focus of laser beams from all the light emitting points, then the depth of focus $d_e$, distance ΔS, and the curvature of field $C_f$ should have the following relationship:

$$d_e-(\Delta S+C_f)>0,$$

In other words, $$d_e-(\alpha\cdot\Delta Z+C_f)>0 \quad (1)$$

Accordingly, the longitudinal magnification α of the entire optical system has to satisfy the following inequality:

$$\alpha<(d_e-C_f)/\Delta Z$$

In other words, by designing the entire optical system to have a longitudinal magnification a of an amount smaller than an amount expressed by $(d_e-C_f)/\Delta Z$, then it will become possible to allow the laser beams emitted from all the light emitting points ch1, ch2 to form sufficiently small-sized beam spots on the scan surface of the photosensitive drum 20, regardless of the amount of the curvature of field.

Especially, according to the present embodiment, the photosensitive drum 20 is located at such a position that the surface of the photosensitive drum 20 will intersect with the substantial center C of the range of the amount $d_{e2}$ $(=d_e-\Delta S-C_f)$ that is defined as shown in FIG. 6. Accordingly, even if the optical components, such as the collimator lens 92 and the scan lenses 42 and 45, are located at positions that are erroneously shifted from their correct positions, or have their refractive power varying due to environmental fluctuations, it can be ensured that the surface of the photosensitive drum 20 be positioned within the range of the amount $d_{e2}$.

The present inventors produced the laser beam printer 1 having the structure described above, and confirmed that the value of $d_{e2}$ $(=d_e-(\Delta S+C_f))$ can have a positive value (2 mm in the example of FIG. 7) over the entire range along the main scanning direction M of the photosensitive drum 20 as shown in FIG. 7.

More specifically, in the graph of FIG. 7, as indicated by a lower broken line, the edge of the focal depth, at the near side to the toric lens 45, of the beam from the light emitting point ch2 becomes furthest from the toric lens 45 when the beam is at the scanning position of about −32 mm. This position is at about −1 mm from the photosensitive drum surface, and is referred to as the "furthest position of the near-side edge of focal depth of beam ch2". As indicated by an upper solid line, the edge of the focal depth, at the far side from the toric lens 45, of the beam from the light emitting point ch1 becomes nearest to the toric lens 45 when the beam is at the scanning position of about +105 mm. This position is at about +1 mm from the photosensitive drum surface, and is referred to as the "nearest position of the far-side edge of focal depth of beam ch1". The amount $d_{e2}$ ($=d_e-(\Delta S+C_f)$), at all the scanning positions, has an amount equal to the distance, along the beam depth direction, between the furthest position (−1 mm) of the near-side edge of focal depth of beam ch2 and the nearest position (+1 mm) of the far-side edge of focal depth of beam ch1". Thus, the amount $d_{e2}$ ($=d_e-(\Delta S+C_f)$), at all the scanning positions, has the amount of about 2 mm.

The present inventors further confirmed that according to the produced laser printer 1, laser beams from both of the light emitting points ch1 and ch2 can be focused into sufficiently small-sized beam spots on the scan surface of the photosensitive drum 20 at all the positions along the main scanning direction M. It was verified that the laser beam printer 1 according to the embodiment can produce two different scanning lines, which are arranged along the auxiliary scanning direction A, by scanning sufficiently small-sized beam spots along the entire range in the main scanning direction M. Accordingly, a high quality image can be produced speedily.

Figure 8:
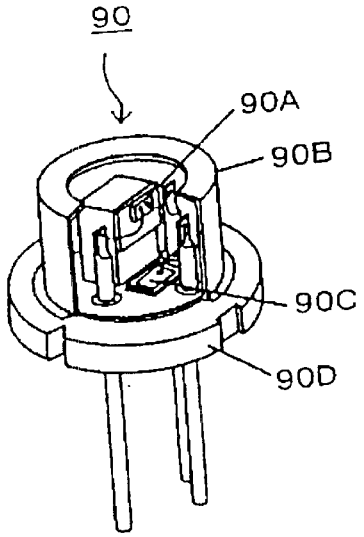
FIG. 8 is a perspective view showing a structure of a semiconductor laser in the multi-beam scanner.

It is noted that as shown in FIG. 8, the laser diode 90 includes: one or two laser element 90A (one, in this example) and a PIN photoreceptor 90C, both of which are mounted on a stem 90D and covered with a cap 90B. Depending on how the stem 90D is installed to the multi-beam scanner 40, the light emitting surface 900 of the laser device 90A will possibly be tilted, as shown in FIG. 4 or 5, at an angle $\phi$ with respect to a plane that is normal to the optical axis Z of the optical system including the collimator lens 92.

Figure 9:
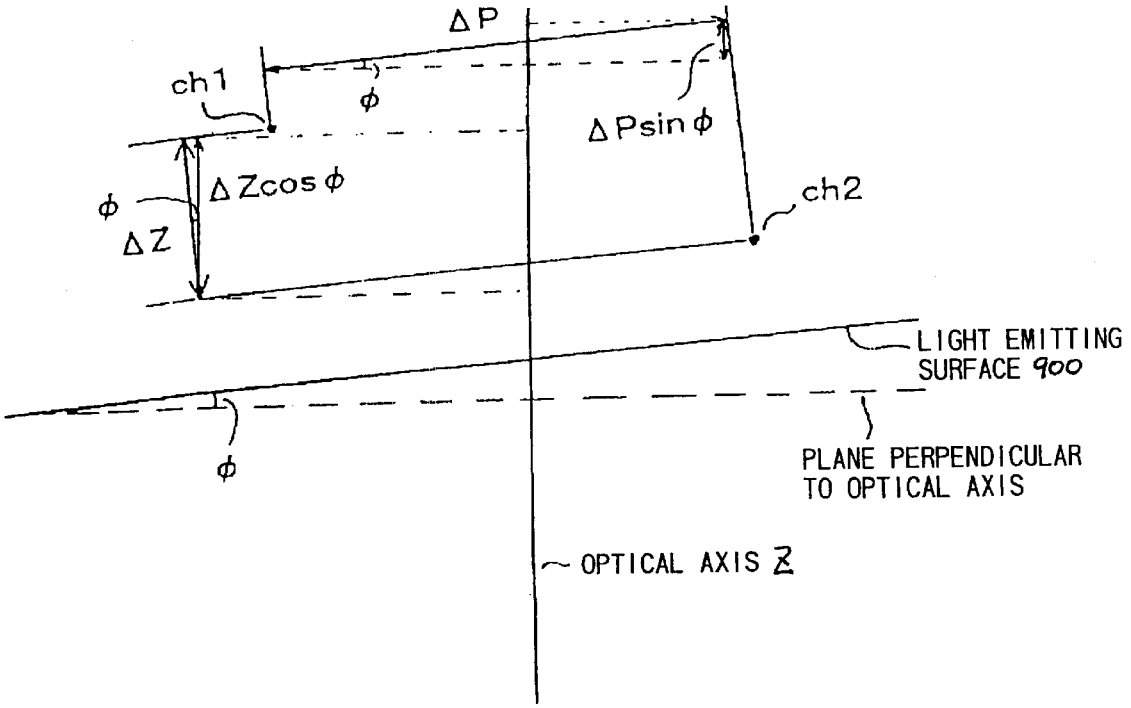
FIG. 9 is an explanatory diagram of a distance between light emitting points along the optical axis.

In such a case, as shown in FIG. 9, the distance between the light emitting points ch1 and ch2, along the depth direction along the optical axis Z, can be determined as $((\Delta Z)\cos\phi+(\Delta p)\sin\phi)$ if $\Delta Z$ is a distance between the light emitting points ch1 and ch2 along a direction normal to the light emitting surface 900 and if $\Delta p$ is a distance between the light emitting points ch1 and ch2 along a plane parallel to the light emitting surface 900.

Accordingly, when the light emitting surface 900 is tilted at an angle $\phi$ as shown in FIG. 9, the inequality (1) should be expressed as follows by substituting the distance ($\Delta z\cos\phi+\Delta p\sin\phi$) for the distance $\Delta Z$:

$$\alpha<(d_e-C_f)/(\Delta z\cos\phi+\Delta p\sin\phi) \quad (2)$$

wherein $\Delta z$ is a distance between the light emitting points ch1 and ch2 along a direction normal to the light emitting surface 900, and $\Delta p$ is a distance between the light emitting points ch1 and ch2 along a plane parallel to the light emitting surface 900.

By designing the optical system using the inequality (2) described above, it can be ensured that the surface of the photosensitive drum 20 be positioned within the range of the amount $d_{e2}$ even if the laser element(s) 90A is mounted at a tilt angle $\phi$ with respect to the optical axis Z.

The condition shown in inequality (1) is effective when the laser element(s) 90A is mounted so that the light emitting surface 900 of the laser element(s) 90A becomes perfectly perpendicular to the optical axis Z. It is difficult to mount the laser element(s) 90A so that its light emitting surface 900 is perfectly perpendicular to the optical axis Z. Therefore, it is preferable that the optical system be designed to satisfy the inequality (2) so that high quality images can be obtained.

It is further noted that in the optical system of the multi-beam scanner 40, the depth of focus of the laser beams is deeper or longer in the auxiliary scanning direction A than in the main scanning direction M. Also, the depth of focus is more easily affected in the main scanning direction M by longitudinal magnification of the entire optical system, the curvature of field, and tilt of the laser element(s) 90A with respect to the optical axis Z, than in the auxiliary scanning direction A. Therefore, if conditions for the range of the amount $d_{e2}$ are satisfied for the depth of focus in the main scanning direction M, then conditions for the range of the amount $d_{e2}$ for the depth of focus in the auxiliary scanning direction A can also be considered satisfied.

The conditions for the range of the amount $d_{e2}$ for the depth of focus in the main scanning direction M can be represented by modifying the inequality (1) into the following inequality (3):

$$d_{em}-(\alpha_m\cdot\Delta z_m+C_{fm})>0 \quad (3)$$

wherein:

$\alpha_m$ is a longitudinal magnification of the optical system with respect to the main scanning direction M;

$d_{em}$ is the depth of focus along the main scanning direction M;

$\Delta z_m$ is the distance, along the depth direction of laser beams, between the center positions of radiations, in the main scanning direction M, from the light emitting points ch1 and ch2; and $C_{fm}$ is the amount of the curvature of field, along the main scanning direction M, of the optical system.

Accordingly, if the multi-beam scanner 40 is designed with longitudinal magnification $\alpha_m$ and depth of focus $d_{em}$ in the main scanning direction M that satisfy the conditions of inequality (3) described above, then, regardless of the curvature of field in the main scanning direction M, the laser beams from both light emitting points ch1 and ch2 will form, on the scan surface of the photosensitive drum 20, beam spots in a sufficiently small size along the main scanning direction. Because the inequality (3) is satisfied for the main scanning direction M, it is ensured that the scan surface of the photosensitive drum 20 be within the depth of focus of the laser beams also in the auxiliary scanning direction A. Accordingly, the surface of the photosensitive drum 20 can be speedily scanned with the laser beams properly focused in both the main and auxiliary scanning directions.

Next will be described an example of how to set the longitudinal magnification $\alpha_m$ along the main scanning direction M.

The longitudinal magnification $\alpha_m$ can be represented using the following equation:

$$\alpha_m=(f_m/f_{co})^2,$$

wherein $f_m$ is the focal length, in the main scanning direction M, of the scan lenses, that is constructed from the fθ lens 42 and the toric lens 45; and $f_{co}$ is the focal length of the collimator lens 92.

It is therefore apparent that by adjusting the focal length $f_{co}$ of the collimator lens 92, the longitudinal magnification $\alpha_m$ in the main scanning direction M can be set to a desired value.

In other words, the inequality (3) can be expressed in terms of focal lengths $f_{co}$ and $f_m$ as follows:

$$(f_m/f_{co})^2 \cdot \Delta z_m + C_{fm} < d_{em} \quad (4)$$

Accordingly, by setting the amount of the focal length $f_{co}$ of the collimator lens 92 to satisfy the inequality (4), the laser beams from both of the light emitting points ch1, ch2 will form, on the scan surface of the photosensitive drum 20, beam spots in a sufficiently-small size in the main scanning direction M, regardless of the curvature of field in the main scanning direction M. Accordingly, the laser beams will form, on the scan surface of the photosensitive drum 20, beam spots in a sufficiently-small size also in the auxiliary scan direction A.

Even when the surface 900 of the laser element(s) 90A is tilted against the optical axis Z, it is still possible to precisely design the optical system by substituting the value ($\Delta z_m \cos \phi + \Delta p_m \sin \phi$) for the value $\Delta z_m$ in the inequalities (3) and (4), where the distance $\Delta p_m$ represents the distance between the light emitting points ch1 and ch2 along a plane parallel to the light emitting surface 900 in the main scanning direction M, and $\Delta z_m$ now represents a distance, along a direction normal to the light emitting surface 900, between the center positions of radiations, in the main scanning direction M, from the light emitting points ch1 and ch2.

The above description describes how to design the optical system by setting the amount of the longitudinal magnification $\alpha$ according to inequality (1). However, the inequality (1) can be modified into the following inequality (5):

$$d_e > (\alpha \cdot \Delta Z + C_f) \quad (5)$$

It is apparent that the optical system can be designed by setting the amount of the depth of focus $d_e$ to satisfy the inequality (5). In other words, by designing the optical system so that the depth of focus $d_e$ will become greater than the value of ($\alpha \cdot \Delta Z + C_f$), then the laser beams from both of the light emitting points ch1, ch2 will form, on the scan surface of the photosensitive drum 20, sufficiently-small beam spots, regardless of the curvature of field.

The image-side numerical aperture NA is a factor to determine the depth of focus $d_e$. Accordingly, it is possible to set the depth of focus $d_e$ to a desired value by adjusting the amount of the numerical aperture NA. The image-side numerical aperture NA indicates an angle of spread of a laser beam as viewed from the photosensitive drum 20. The image-side numerical aperture NA therefore includes a main-scanning-direction numerical aperture $NA_m$, which is defined along the main scanning direction M, and an auxiliary-scanning-direction numerical aperture $Na_s$, which is defined along the auxiliary-scanning direction A.

Figure 10A:
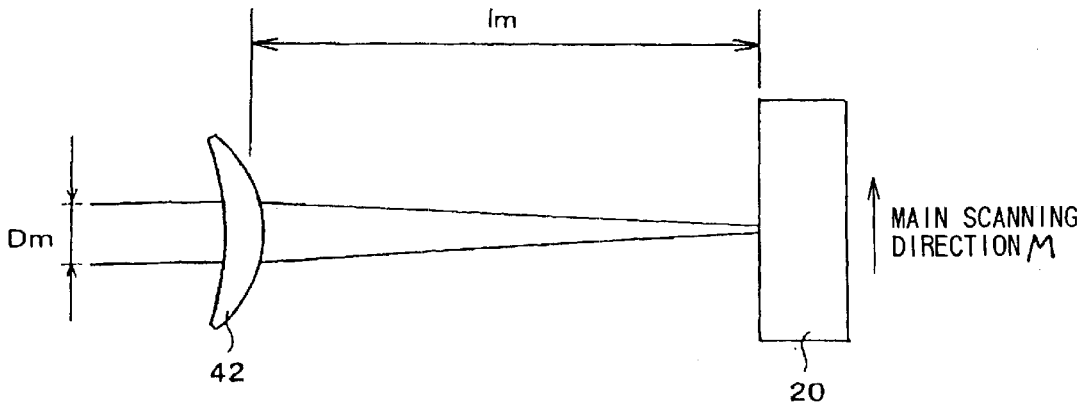
FIG. 10A is a diagram explaining the numerical aperture in the main scanning direction.

As shown in FIG. 10A, the main-scanning-direction numerical aperture $NA_m$ can be represented using the following equation:

$$NA_m = D_m/(2 \cdot l_m)$$

wherein $D_m$ is the width of the laser beam along the main scanning direction M where it falls incident on the fθ lens 42; and $l_m$ is the length, in the main scanning direction M, from the principal plane of the fθ lens 42 to the surface of the photosensitive drum 20.

Figure 10B:
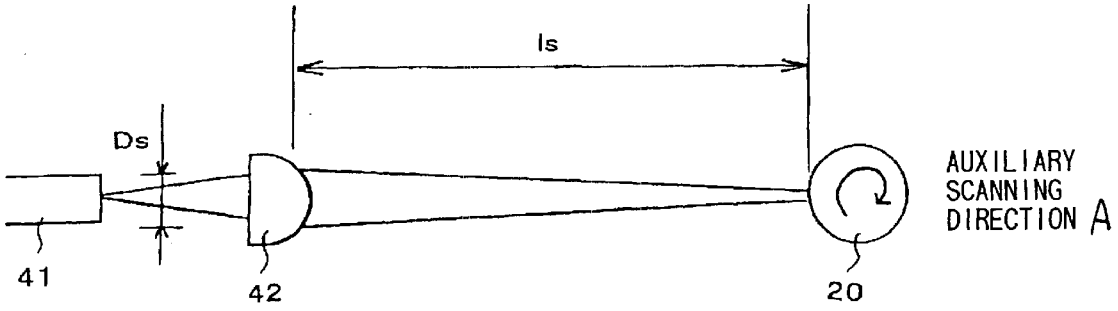
FIG. 10B is a diagram explaining the numerical aperture in the auxiliary scanning direction.

Similarly, as shown in FIG. 10B, the auxiliary-scanning direction numerical aperture $NA_s$ can be represented using the following equation:

$$NA_s D_s/(2 \cdot l_s)$$

wherein $D_s$ is the width of the laser beam in the auxiliary scanning direction A where it falls incident on the fθ lens 42; and $l_s$ is the length, along the auxiliary scanning direction, from the principal plane of the fθ lens 42 to the surface of the photosensitive drum 20.

It is noted that the width of the laser beam where it falls incident on the fθ lens 42 can be changed by adjusting the width of the laser beam. The width of the laser beam can be adjusted by changing the width of the slit 93A in the diaphragm 93 which is provided to the rear of the collimator lens 92. Thus, the values of both of the main-scanning direction numerical aperture $NA_m$ and the auxiliary-scanning-direction numerical aperture $NA_s$ can be adjusted by changing the widths, in the main and auxiliary scanning directions, of the slit 93A in the diaphragm 93.

Next, the relationship between the image-side numerical aperture NA and the depth of focus $d_e$ will be described.

As described already, the depth of focus $d_e$ is defined as the range in which a light beam can form an acceptable image on a surface even when the surface is shifted from the focal point of the light beam. The depth of focus can be defined as an amount of wavefront aberration, because wavefront aberration is generated when the image point is shifted away from the correct focal point.

Figure 11:
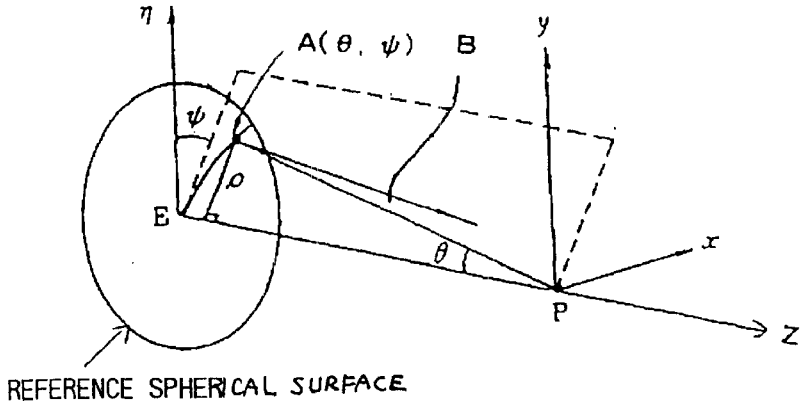
FIG. 11 is a diagram explaining wavefront aberration.

Wavefront aberration will be explained below with reference to a coordinate system of FIG. 11, wherein an imaging field coordinate system is defined as (x, y, z), the optical axis is the z axis, and the yz plane is the meridional plane. To facilitate explanation, it will be assumed that a reference image point P is located on the optical axis z. A line AP is defined as connecting the reference image point P with a point A, where a light ray B intersects a reference spherical surface. An angle θ is defined as an angle between the optical axis z and the line AP. An angle ω is defined as an angle between the meridional plane, that is, the yz plane, and a plane that includes both the z axis and the point A. The wavefront aberration W can be expressed as (θ,ω). Assuming that the origin E of the coordinate system of FIG. 11 is the point where the principal ray intersects the optical axis z at the image side, then the ξη plane is the exit pupil plane, where the axis η is within the meridional plane, and the axis ξ is perpendicular to the axis η and parallel to the axis X.

A wavefront aberration W' in the image surface can be expressed using the following equation (6):

$$W' = W_0 + \delta W \quad (6)$$

wherein $W_0$ is the portion of the wavefront aberration W' that is inherent to the optical system; and δW is the portion that is attributed to movement of the image point.

Thus, the wavefront aberration W' can be expressed as a linear sum of the inherent wavefront aberration $W_0$ and the image-movement wavefront aberration δW.

It is noted that the image-movement wavefront aberration δW can be expressed using the following equation:

$$\delta W = \delta W_L + \delta W_T \quad (7)$$

wherein $\delta W_L$ is the wavefront aberration that is attributed to displacement z in the optical axis direction of the image point; and $\delta W_T$ is the change in wavefront aberration with respect to displacement y of the image point in a direction that is perpendicular to the optical axis z and that is within the meridional plane.

It is noted that the wavefront aberration $\delta W_L$ can be represented by the following equation:

$$\delta W_L=-(1-\cos\theta)\cdot z=-(\sin^2\theta/2)\cdot z=-(NA^2/2)\cdot z \quad (8)$$

The wavefront aberration $\delta W_T$ can be represented by the following equation:

$$\delta W_T=-y\ (\sin\theta)(\cos\omega)=-y\ NA\ (\cos\omega) \quad (9)$$

Accordingly, when the image point moves both in the optical axis direction and in the direction perpendicular to the optical axis direction, the wavefront aberration change $\delta W$ is generated to have the value represented as follows:

$$\delta W=\delta W_L+\delta W_T=-(NA^2/2)\cdot z-y\ NA\ (\cos\omega) \quad (10)$$

Figure 12:
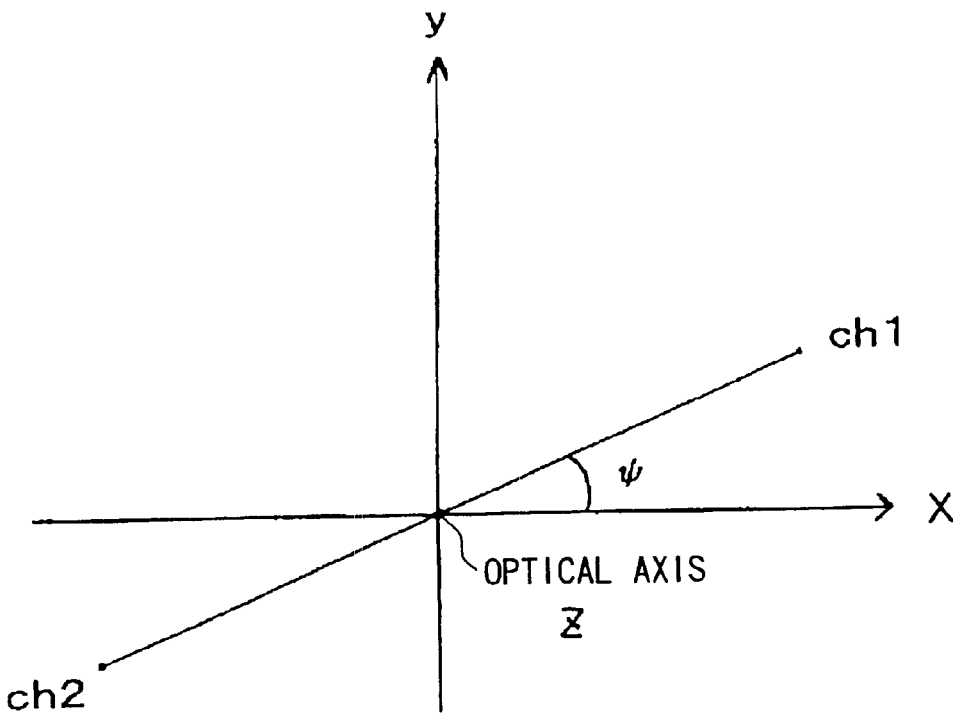
FIG. 12 is a diagram explaining a shift of image points on the photosensitive body as viewed from a scan lens.

In the multi-beam scanner 40, when viewed from the fθ lens 42, image points of the light emitting points ch1, ch2 are generated on the photosensitive drum 20 as shown in FIG. 12 so that the image points are positionally shifted from the xz plane by an angle ω. The image points are shifted from each other also with respect to the optical axis direction. Therefore, by using the above-described equation (10) that determines the change in the wavefront aberration, it is possible to calculate the conditions that result in the image point with the smallest wavefront aberration.

It is noted that in FIG. 12, the deviation in the y-axis direction is small compared to deviation in the x-axis direction. Accordingly, the angle ω can be considered to be almost 0°. The equation (9) can therefore be written as follows:

$$\delta W_T=-yNA$$

Thus, the equation (10) can be written as follows:

$$\delta W=-(NA^2/2)\cdot z-yNA$$

Accordingly, the equation (6) for the wavefront aberration W' can be written as follows:

$$W'=W_0+\delta W_L+\delta W_T=W_0-(NA^2/2)\cdot z-yNA \quad (11)$$

Using the equation (11), it is possible to calculate the intensity distribution which is attained when the image points move. Strehl definition SD, which indicates drop in central intensity I, is generally used to gauge quality of images in an optical system. If the central intensity I at a location, which is shifted from the actual focal point, is 80% or more of the intensity $I_0$ at the focal point, then this means that the lens or the optical system is almost ideal. The range where the intensity I is 80% or more of intensity $I_0$ is the depth of focus of the ideal lens or optical system.

According to the well-known Reyleigh Limit, wavefront aberration that provides the Strehl definition SD of equal to or more than 80% should be restricted to within a quarter of the wavelength to assure essentially perfect image quality.

Equation (11) can be rewritten as follows when the wavefront aberration W' has a value of λ/4 (λ is a wave length of the semiconductor laser 90):

$$\lambda/4=W_0-(NA^2/2)\cdot z_0-yNA,$$

wherein $z_0$ is the shift in the optical axis direction from the focal point of the image point, when the wavefront aberration is a quarter of the wavelength.

The above equation can be rewritten as follows:

$$-z_0=(\lambda/2NA^2)+(2y/NA)-(2W_0/NA^2)$$

Because the depth of focus $d_e$ is defined by $2|z_0|$, the depth of focus $d_e$ can be expressed as follows:

$$d_e=2|z_0|=2((\lambda/2NA^2)+(2y/NA)-(2W_0/NA^2))$$

Because inequality (5) shows that $d_e>(\alpha\cdot\Delta Z+C_f)$, the following relationship can be established:

$$2((\lambda/2NA^2)+(2y/NA)-(2W_0/NA^2))>(\alpha\cdot\Delta Z+C_f) \quad (12)$$

From inequality (12), it can be understood that the smaller the image-side numerical aperture NA, the larger the depth of focus $d_e$, and contrarily, the larger the image-side numerical aperture NA, the smaller the depth of focus $d_e$.

Accordingly, by adjusting the image-side numerical aperture NA to satisfy the inequality (12), then inequality (5) can be satisfied.

It should be noted that by substituting the value of (Δz cos φ+Δp sin φ) for the value of ΔZ in inequality (12), the following relationship can be established:

$$2((\lambda/2NA^2)+(2y/NA)-(2W_0/NA^2))>(\alpha\cdot(\Delta z\cos\phi+\Delta p\sin\phi)+C_f) \quad (13)$$

wherein Δz is now a distance between the light emitting points ch1 and ch2 along a direction normal to the light emitting surface 900, and Δp is a distance between the light emitting points ch1 and ch2 along a plane parallel to the light emitting surface 900.

By designing the optical system based on the inequality (13), the surface of the photosensitive drum 20 can be properly positioned within the range of the amount $d_{e2}$ even when the laser element(s) 90A is attached as being tilted with respect to the optical axis Z. In other words, the conditions of inequality (12) are effective when the laser diode 90 is attached with the light emitting surface 900 of the laser element(s) 90A being perpendicular to the optical axis Z. However, it is difficult to realize such a perpendicular orientation. Accordingly, the optical system should preferably be designed according to the inequality (13) in order to obtain high-quality images.

It should be further noted that in the same manner as for inequality (3), if conditions of inequality (12) are satisfied for the range $d_{e2}$ for the depth of focus in the main scanning direction M, then the conditions for the depth of focus in the auxiliary scanning direction A will also be satisfied.

Here, inequality (12) can be modified as follows:

$$2((\lambda/2NA_m^2)+(2y/NA_m)-(2W_0/NA_m^2))>(\alpha\text{hd m}\cdot\Delta z_m+C_{fm}) \quad (14)$$

wherein $NA_m$ is the image-side numeric aperture in the main scanning direction M;

$\Delta z_m$ is the distance, along the depth direction, between the center positions of radiations, along the main scanning direction M, from the light emitting points ch1 and ch2;

$\alpha_m$ is the longitudinal magnification of the optical system in the main scanning direction; and $C_{fm}$ is the amount of the curvature of field of the optical system along the main scanning direction.

If the main-scan-image-side numeric aperture $NA_m$ satisfies the relationship expressed in inequality (14), then the beams from the light emitting points ch1, ch2 will form sufficiently small beam spots on the surface of the photosensitive drum 20, regardless of the curvature of field in the main scanning direction M. Also, by satisfying inequality (14), the surface of the photosensitive drum 20 can be maintained within the depth of focus also in the auxiliary scanning direction A. Therefore, scanning with laser beams properly focused in both of the main and auxiliary scanning directions can be achieved.

It should be noted that the optical system can be properly designed to take into account that the laser element(s) 90A tilts with respect to the optical axis, by replacing $\Delta z_m$ in inequality (14) by $(\Delta z_m \cos \phi + \Delta p_m \sin \phi)$ where $\Delta p_m$ is the distance between the light emitting points ch1 and ch2 along a plane parallel to the light emitting surface 900 of the laser diode 90, and $\Delta z_m$ is now the distance, along a direction normal to the light emitting surface 900, between the center positions of radiations, along the main scanning direction M, from the light emitting points ch1 and ch2.

As described above, according to the present embodiment, the multi-beam scanner 40 has two light emitting points ch1, ch2 and an optical system, constructed from the components 91, 92, 93, 94, 41, 42, and 45. The light emitting points ch1, ch2 are separated by a distance ΔS along the depth-of-focus direction. The longitudinal magnification α, or the image-side numerical aperture NA, of the optical system is set so that the surface to be scanned of the photosensitive drum 20 is positioned within a range where the depths of focus $d_e$ of the light beams from the two light emitting points ch1, ch2 overlap. The multi-beam scanner 40 can therefore focus the light beams onto the surface of the photosensitive drum 20 at all the scanning positions even when the optical system has the curvature of field.

While the invention has been described in detail with reference to the specific embodiment thereof, it would be apparent to those skilled in the art that various changes and modifications may be made therein without departing from the spirit of the invention.

What is claimed is:

1. A multi-beam scanner, comprising:

a light-emitting unit which has a plurality of light emitting portions for emitting a plurality of light beams, the plurality of light emitting portions being separated from one another in a depth direction of the light beams;

a scanning unit that deflects the light beams in a main scanning direction in a plurality of lines across a surface of an object to be scanned, the plurality of lines being arranged along an auxiliary scanning direction that is substantially perpendicular to the main scanning direction; and a light converging unit converging the plurality of light beams onto the surface of the object to be scanned, the light converging unit allowing depths of focus of the light beams from all the light emitting portions to overlap on the surface of the object, wherein an amount of a range where depths of focus of the light beams from all the light emitting portions overlap has a positive value at all the scan positions of the surface of the object, wherein the light converging unit has a longitudinal magnification of a value setting the amount of the overlapping range to a positive value at all the scan positions of the surface of the object.

2. A multi-beam scanner as claimed in claim 1, wherein the light converging unit has a longitudinal magnification α of a value that sets the amount of the overlapping range $(d_e - \Delta S)$ to a positive value at all the scan positions of the surface of the object, wherein $d_e$ is the amount of the focal depth of the light beams from the light emitting portions and ΔS is a distance between beam waist positions of the light beams in the depth direction.

3. A multi-beam scanner as claimed in claim 2, wherein the light converging unit has a longitudinal magnification a satisfying an inequality of $(d_e - \alpha \cdot \Delta Z) > 0$ at all the scan positions of the surface of the object, wherein ΔZ is a distance separating the light emitting portions in the depth direction.

4. A multi-beam scanner as claimed in claim 3, wherein the light converging unit has a longitudinal magnification a satisfying an inequality of $d_e - (\alpha \cdot \Delta Z + C_f) > 0$ at all the scan positions of the surface of the object, wherein $C_f$ is an amount of the curvature of field in the light converging unit.

5. A multi-beam scanner as claimed in claim 4, wherein the amount of $(\Delta z \cos \phi + \Delta p \sin \phi)$ is substituted for the distance (ΔZ)

wherein φ is an angle defined between a light emitting surface of the light-emitting unit and a plane normal to the optical axis of the light converging unit: and Δp is a distance separating the plurality of light emitting portions along a plane parallel with the light emitting surface.

6. A multi-beam scanner as claimed in claim 1, wherein the center portions of radiations from the plurality of light emitting portions, along the main scanning direction, are separated from one another in the depth direction of the light beams, the light converging unit allowing depths of focus, along the main scanning direction, of the light beams from all the light emitting portions to overlap on the surface of the object.

7. A multi-beam scanner as claimed in claim 6, wherein an amount of a range where depths of focus, along the main scanning direction, of the light beams from all the light emitting portions overlap has a positive value at all the scan positions of the surface of the object.

8. A multi-beam scanner, comprising:

a light-emitting unit which has a plurality of light emitting portions for emitting a plurality of light beams, the plurality of light emitting portions being separated from one another in a depth direction of the light beams;

a scanning unit that deflects the light beams in a main scanning direction in a plurality of lines across a surface of an object to be scanned, the plurality of lines being arranged along an auxiliary scanning direction that is substantially perpendicular to the main scanning direction; and a light converging unit converging the plurality of light beams onto the surface of the object to be scanned, the light converging unit allowing depths of focus of the light beams from all the light emitting portions to overlap on the surface of the object, wherein the center portions of radiations from the plurality of light emitting portions, along the main scanning direction, are separated from one another in the depth direction of the light beams, the light converging unit allowing depths of focus, along the main scanning direction, of the light beams from all the light emitting portions to overlap on the surface of the object, an amount of a range where depths of focus, along the main scanning direction, of the light beams from all the light emitting portions overlap has a positive value at all the scan positions of the surface of the object, and the light converging unit has a longitudinal magnification, along the main scanning direction, of a value setting the amount of the overlapping range to a positive value at all the scan positions of the surface of the object.

9. A multi-beam scanner as claimed in claim 8, wherein the light converging unit has a longitudinal magnification $\alpha_m$, along the main scanning direction, of a value that sets the amount of the overlapping range $(d_{em} - \Delta S_m)$ to a positive value at all the scan positions of the surface of the object, wherein $d_{em}$ is the amount of the focal depth, along the main scanning direction, of the light beams from the light emitting portions and $\Delta S_m$ is a distance between beam waist positions, along the main scanning direction, of the light beams in the depth direction.

10. A multi-beam scanner as claimed in claim 9, wherein the light converging unit has a longitudinal magnification $\alpha_m$, along the main scanning direction, satisfying an inequality of $(d_{em}-\alpha_m \cdot \Delta Z_m)>0$ at all the scan positions of the surface of the object, wherein $\Delta Z_m$ is a distance separating, in the depth direction, the central positions of the radiations, along the main scanning direction, from the light emitting portions.

11. A multi-beam scanner as claimed in claim 10, wherein the light converging unit has a longitudinal magnification $\alpha_m$, along the main scanning direction, that satisfies an inequality of $d_{em}-(\alpha_m \cdot \Delta Z_m+C_{fm})>0$ at all the scan positions of the surface of the object, wherein $C_{fm}$ is the amount of the curvature of field, along the main scanning direction, in the light converging unit.

12. A multi-beam scanner as claimed in claim 11, wherein the amount of $(\Delta z_m \cos \phi+\Delta p \sin \phi)$ is substituted for the distance $(\Delta Z_m)$, wherein $\phi$ is an angle defined between a light emitting surface of the light-emitting unit and a plane normal to the optical axis of the light converging unit; and $\Delta p$ is a distance separating the plurality of light emitting portions along a plane parallel to the light emitting surface.

13. A multi-beam scanner, comprising:

a light-emitting unit which has a plurality of light emitting portions for emitting a plurality of light beams, the plurality of light emitting portions being separated from one another in a depth direction of the light beams;

a scanning unit that deflects the light beams in a main scanning direction in a plurality of light beams onto the surface of the object to be scanned, in a plurality of lines across a surface of an object to be scanned, the plurality of lines being arranged along an auxiliary scanning direction that is substantially perpendicular to the main scanning direction; and a light converging unit converging the plurality of light beams onto the surface of the object to be scanned, the light converging unit allowing depths of focus of the light beams from all the light emitting portions to overlap on the surface of the object, wherein the center portions of radiations from the plurality of light emitting portions, along the main scanning direction, are separated from one another in the depth direction of the light beams, the light converging unit allowing depths of focus, along the main scanning direction, of the light beams from all the light emitting portions to overlap on the surface of the object, and the light converging unit includes:

a collimate lens, that is disposed between the light emitting unit and the scanning unit, for collimating, into approximate parallel beams, the light beams emitted from the light emitting points, the collimate lens having a focal length $f_{co}$; and a scan lens unit, that is disposed between the scanning unit and the object to be scanned, for scanning the collimated light, which is deflected by the scanning unit, in the plurality of lines on the surface of the object to be scanned, the scan lens having a focal length $f_m$ in the main scanning direction, the focal length $f_{co}$ and the focal length $f_m$ satisfying the following inequality:

$$(f_m/f_{co})^2 \cdot \Delta z_m+C_{fm}<d_{em}.$$

14. A multi-beam scanner, comprising:

a light-emitting unit which has a plurality of light emitting portions for emitting a plurality of light beams, the plurality of light emitting portions being separated from one another in a depth direction of the light beams;

a scanning unit that deflects the light beams in a main scanning direction in a plurality of lines across a surface of an object to be scanned, the plurality of lines being arranged along an auxiliary scanning direction that is substantially perpendicular to the main scanning direction; and a light converging unit converging the plurality of light beams onto the surface of the object to be scanned, the light converging unit allowing depths of focus of the light beams from all the light emitting portions to overlap on the surface of the object, wherein an amount of a range where depths of focus of the light beams from all the light emitting portions overlap has a positive value at all the scan positions of the surface of the object, and the light converging unit has an image-side numerical aperture of a value setting the amount of the overlapping range to a positive value at all the scan positions of the surface of the object.

15. A multi-beam scanner as claimed in claim 14, wherein the light converging unit has an image-side numerical aperture NA of a value that sets the amount of the overlapping range $(d_e-\Delta S)$ to a positive value at all the scan positions of the surface of the object, wherein $d_e$ is the amount of the focal depth of the light beams from the light emitting portions and $\Delta S$ is a distance between beam waist positions of the light beams in the depth direction.

16. A multi-beam scanner as claimed in claim 15, wherein the light converging unit has an image-side numerical aperture NA satisfying, at all the scan positions of the surface of the object, the following inequality:

$$2(\lambda NA^2+2y/NA-2W_0/NA^2)>\alpha \cdot \Delta Z+C_f,$$

wherein $\Delta Z$ is a distance separating the light emitting portions in the depth direction, $\alpha$ is a longitudinal magnification of the light converging unit, $C_f$ is an amount of the curvature of field in the light converging unit;

$W_0$ is an inherent wavefront aberration of the light converging unit;

$\lambda$ is a wavelength of the light beams; and y is a height of an image.

17. A multi-beam scanner as claimed in claim 16, wherein the amount of $(\Delta z \cos \phi \Delta p \sin \phi)$ is substituted for the distance $(\Delta Z)$, wherein $\phi$ is an angle defined between a light emitting surface of the light-emitting unit and a plane normal to the optical axis of the light converging unit; and $\Delta p$ is a distance separating the plurality of light emitting portions along a plane parallel to the light emitting surface.

18. A multi-beam scanner as claimed in claim 14, wherein the light converging unit includes a alit that is disposed between the light-emitting unit and the scanning unit and that has a width that allows the image-side numerical aperture of the light converging unit to set the amount of the overlapping range to a positive value at all the scan positions of the surface of the object.

19. A multi-beam scanner, comprising:

a light-emitting unit which has a plurality of light emitting portions for emitting a plurality of light beams, the plurality of light emitting portions being separated from one another in a depth direction of the light beams;

a scanning unit that deflects the light beams in a main scanning direction in a plurality of lines across a surface of an object to be scanned, the plurality of lines being arranged along an auxiliary scanning direction that is substantially perpendicular to the main scanning direction; and a light converging unit converging the plurality of light beams onto the surface of the object to be scanned, the light converging unit allowing depths of focus of the light beams from all the light emitting portions to overlap on the surface of the object, wherein the center portions of radiations from the plurality of light emitting portions, along the main scanning direction, are separated from one another in the depth direction of the light beams, the light converging unit allowing depths of focus, along the main scanning direction, of the light beams from all the light emitting portions to overlap on the surface of the object, an amount of a range where depths of focus, along the main scanning direction, of the light beams from all the light emitting portions overlap has a positive value at all the scan positions of the surface of the object, and the light converging unit has an image-side numerical aperture, along the main scanning direction, of a value setting the amount of the overlapping range to a positive value at all the scan positions of the surface of the object.

20. A multi-beam scanner as claimed in claim 19, wherein the light converging unit has an image-side numerical aperture $NA_m$, along the main scanning direction, of a value that sets the amount of the overlapping range $(d_{em}-\Delta S_m)$ to a positive value at all the scan positions of the surface of the object, wherein $d_{em}$ is the amount of the focal depth, along the main scanning direction, of the light beams from the light emitting portions and $\Delta S_m$ is a distance between beam waist positions, along the main scanning direction, of the light beams in the depth direction.

21. A multi-beam scanner as claimed in claim 20, wherein the light converging unit has an image-side numerical aperture $NA_m$, along the main scanning direction, that satisfies, at all the scan positions of the surface of the object, the following inequality:

$$2(\lambda NA_m^2+2y_m/NA_m 2W_0/NA_m^2)>\alpha\cdot\Delta Z_m+C_{fm},$$

wherein $\Delta Z_m$ is a distance separating, in the depth direction, the center portions of radiations, along the main scanning direction, from the light emitting portions, $\alpha_m$ is a longitudinal magnification, along the main scanning direction, of the light converging unit, $C_{fm}$ is an amount of the curvature of field, along the main scanning direction, in the light converging unit; $W_0$ is an inherent wavefront aberration of the light converging unit;

k is a wavelength of the light beams; and $y_m$ is a height of an image.

22. A multi-beam scanner as claimed in claim 21, wherein the amount of $(\Delta z_m \cos\phi+\Delta p \sin\phi)$ is substituted for the distance $(\Delta Z_m)$, wherein $\phi$ is an angle defined between a light emitting surface of the light-emitting unit and a plane normal to the optical axis of the light converging unit; and $\Delta p$ is a distance separating the plurality of light emitting portions along a plane parallel to the light emitting surface.

23. A multi-beam scanner, comprising:

a light-emitting unit which has a plurality of light emitting portions for emitting a plurality of light beams, the plurality of light emitting portions being separated from one another in a depth direction of the light beams;

a scanning unit that deflects the light beams in a main scanning direction in a plurality of lines across a surface of an object to be scanned, the plurality of lines being arranged along an auxiliary scanning direction that is substantially perpendicular to the main scanning direction; and a light converging unit converging the plurality of light beams onto the surface of the object to be scanned, the light converging unit allowing depths of focus of the light beams from all the light emitting portions to overlap on the surface of the object, wherein an amount of a range where depths of focus of the light beams from all the light emitting portions overlap has a positive value at all the scan positions of the surface of the object; and further comprising the object to be scanned, which is driven to rotate in the auxiliary scanning direction, wherein the light converging unit has an amount of the overlapping range $(d_e-\Delta S-C_f)$ to a positive value at all the scan positions of the surface of the object, wherein $d_e$ is the amount of the focal depth of the light beams from the light emitting portions, $\Delta S$ is a distance between beam waist positions of the light beams in the depth direction, and $C_f$ is an amount of the curvature of field in the light converging unit, and the surface of the object to be scanned is located in a substantial center of the overlapping range of $(d_e-\Delta S-C_f)$.

24. An image forming device comprising:

a photosensitive body driven to rotate in the auxiliary scanning direction; and a multi-beam scanner, which includes:

a light-emitting unit which has a plurality of light emitting portions for emitting a plurality of light beams, the plurality of light emitting portions being separated from one another in a depth direction of the light beams;

a scanning unit that deflects the light beams in a main scanning direction in a plurality of lines across a surface of the photosensitive body, the plurality of lines being arranged along an auxiliary scanning direction that is substantially perpendicular to the main scanning direction; and a light converging unit converging the plurality of light beams onto the surface of the photosensitive body, the light converging unit allowing depths of focus of the light beams from all the light emitting portions to overlap on the surface of the photosensitive body, thereby serially irradiating the plurality of light beams on the photosensitive body to form latent images, wherein the surface of the photosensitive body is located in a substantial center of the overlapping range, in the depths of focus of the light beams from all the light emitting points, that has the amount of $(d_e-\Delta S-C_f)$ wherein $d_e$ is the amount of the focal depth of the light beams from the light emitting portions, $\Delta S$ is a distance between beam waist positions of the light beams in the depth direction, and $C_f$ is an amount of the curvature of field in the light converging unit.

* * * * *